US009694360B2

(12) United States Patent
Price et al.

(10) Patent No.: US 9,694,360 B2
(45) Date of Patent: Jul. 4, 2017

(54) FLUID MANIPULATOR HAVING FLEXIBLE BLISTER

(71) Applicant: Bio-Rad Laboratories, Inc., Hercules, CA (US)

(72) Inventors: Glenn Price, Martinez, CA (US); Luis Ortiz Hernandez, Pinole, CA (US); Robert Iovanni, Vallejo, CA (US); William Link, El Cerrito, CA (US)

(73) Assignee: Bio-Rad Laboratories, Inc., Hercules, CA (US)

( * ) Notice: Subject to any disclaimer, the term of this patent is extended or adjusted under 35 U.S.C. 154(b) by 100 days.

(21) Appl. No.: 14/500,710

(22) Filed: Sep. 29, 2014

(65) Prior Publication Data

US 2016/0089670 A1 Mar. 31, 2016

(51) Int. Cl.
*B01L 3/00* (2006.01)

(52) U.S. Cl.
CPC ..... *B01L 3/50273* (2013.01); *B01L 3/505* (2013.01); *B01L 3/502738* (2013.01); *B01L 2300/0803* (2013.01); *B01L 2300/087* (2013.01); *B01L 2300/0816* (2013.01); *B01L 2300/0877* (2013.01); *B01L 2300/123* (2013.01); *B01L 2400/0481* (2013.01); *B01L 2400/0638* (2013.01)

(58) Field of Classification Search
CPC ... B01L 3/50273; B01L 3/505; B01L 3/50278
See application file for complete search history.

(56) References Cited

U.S. PATENT DOCUMENTS 5,288,463 A * 2/1994 Chemelli ..... B01L 3/502 422/417
2005/0009054 A1* 1/2005 Phillion ..... C07D 403/14 435/6.12
2008/0318260 A1 12/2008 Mpock et al.
(Continued)

OTHER PUBLICATIONS

Yang, et al., "Planar Micro-Check Valves Exploiting Large Polymer Compliance," Sensors and Actuators, A 134, (2007), 8 pages.
(Continued)

*Primary Examiner* — Melanie Y Brown
(74) *Attorney, Agent, or Firm* — Kilpatrick Townsend & Stockton LLP

(57) ABSTRACT

A system for fluid manipulation includes a composite wafer and a movable compression device. The composite wafer includes a flexible layer and a substantially rigid layer adhered to the flexible layer. The flexible layer defines one or more recesses that are covered by the substantially rigid layer to form one or more reservoirs and one or more fluid channels among the one or more reservoirs. The movable compression device contacts the flexible layer and is configured to progressively compress the flexible layer such that when the movable compression device traverses the flexible layer, fluid is forced through the one or more fluid channels and the one or more reservoirs in a sequence determined by the layout of the one or more fluid channels and the one or more reservoirs. Certain reservoirs may be pre-loaded with fluids and reagents for performing a specified medical test.

27 Claims, 5 Drawing Sheets

(56) References Cited

U.S. PATENT DOCUMENTS

| | | | | |
|---|---|---|---|---|
| 2009/0221431 | A1* | 9/2009 | Yoo | G01N 35/00069 506/9 |
| 2010/0093019 | A1* | 4/2010 | Ditcham | B01F 3/12 435/34 |
| 2012/0187021 | A1* | 7/2012 | McKenna | B01L 3/50273 206/569 |
| 2014/0194305 | A1* | 7/2014 | Kayyem | B01L 3/502715 506/9 |
| 2014/0270458 | A1* | 9/2014 | Smith | G01N 33/5094 382/134 |

OTHER PUBLICATIONS

Anthony, et al., "Mircovalves and Micropumps for BioMEMS," Micromachines, (2), doi:10.3390/mi202179, (2011), 42 pages.

* cited by examiner

FLUID MANIPULATOR HAVING FLEXIBLE BLISTER

BACKGROUND OF THE INVENTION

A wide variety of systems and methods exist for performing biochemical analysis, for example for medical testing. A common technique is to load analytes and reagents into a microfluidic "chip" that has fluid flow channels and other structures formed in it using photolithography techniques. Such a chip may include pumps, reservoirs, valves, mixing structures, and other features useful in the performance of a certain tests.

Typically, such a chip is controlled by an external controller, through application and release of fluid pressure at key points in the chip. For example, a valve may be formed by crossing a fluid flow channel in a soft medium with a dead-end cross channel. By pressurizing the cross channel, the fluid flow channel can be pinched off, and by releasing the pressure in the cross channel, the fluid flow channel is allowed to re-open. A peristaltic pump may be formed by placing three or more such valves close together crossing a fluid flow channel in a soft medium. By sequentially pressurizing and depressurizing the valves channels to pinch off and re-open adjacent locations in the fluid flow channel, fluid can be caused to flow in the fluid flow channel.

Because of the need for external control, such microfluidic chips are not convenient for use in routine medical testing, especially in remote locations.

BRIEF SUMMARY OF THE INVENTION

According to one aspect, a system for fluid manipulation comprises a composite wafer having a flexible layer and a substantially rigid layer adhered to the flexible layer. The flexible layer defines one or more recesses that are covered by the substantially rigid layer to form one or more reservoirs, and the flexible layer defines one or more fluid channels among the one or more reservoirs. The system further comprises a movable compression device in contact with the flexible layer. The movable compression device is configured to progressively compress the flexible layer such that when the movable compression device traverses the flexible layer, fluid is forced through the one or more fluid channels and the one or more reservoirs in a sequence determined by the layout of the one or more fluid channels and the one or more reservoirs. In some embodiments, the movable compression device is a roller. The movable compression device may be a cylindrical roller. The movable compression device may be a conical roller. In some embodiments, at least one of the one or more reservoirs is pre-loaded with a fluid. In some embodiments, the system further comprises at least one valve formed in the flexible layer, each valve preventing flow of fluid from a pre-loaded reservoir until the fluid is forced from the reservoir by action of the movable compression device. In some embodiments, at least one of the one or more reservoirs is pre-loaded with a diluent. In some embodiments, at least one of the one or more reservoirs is pre-loaded with a reagent. In some embodiments, at least one of the one or more reservoirs is pre-loaded with an antibody. In some embodiments, the substantially rigid layer defines a sample loading port for loading a sample of an analyte into the composite wafer. In some embodiments, the substantially rigid layer defines at least one fluid channel. In some embodiments, the composite wafer further comprises a sampling medium to which fluid is delivered from one of the fluid flow channels. In some embodiments, a first one of the reservoirs is pre-loaded with a diluent; the substantially rigid layer defines a sample loading port connected by one of the fluid flow channels downstream of the first reservoir for loading a sample of an analyte into the composite wafer; and a second one of the reservoirs is connected by one of the fluid flow channels downstream of the sample loading port, such that upon actuation of the movable compression device, diluent is forced from the first reservoir, and carries the analyte to the second reservoir in a test fluid. In some embodiments, the system further comprises a sampling medium, wherein the test fluid is delivered from the second reservoir to the sampling medium via one of the fluid flow channels. In some embodiments, one or two additional reservoirs are disposed between the second reservoir and the sampling medium. In some embodiments, a third reservoir is pre-loaded with a washing fluid, and the substantially rigid layer defines a fluid flow layer that delivers the washing fluid to the sampling medium. In some embodiments, the third reservoir is positioned such that the advancement of the movable compression device forces the buffer from the third reservoir after the test fluid has reached the sampling medium. In some embodiments, the analyte is blood, and the system is configured to perform process steps in the measurement of HbA1c in the blood. The movable compression device may be configured to be manually actuated. The movable compression device and the composite wafer may undergo rotary relative motion. The movable compression device and the composite wafer may undergo linear relative motion. In some embodiments, the system further comprises a protective holder that substantially encloses the flexible layer, the protective holder defining an opening providing access to the flexible layer by the movable compression device.

According to another aspect, a fluid manipulation device comprises a flexible layer having one or more recesses in one face. The one or more recesses define one or more reservoirs and one or more fluid channels among the one or more reservoirs. The system further includes a substantially rigid layer adhered to a face of the flexible layer such that the substantially rigid layer forms a closing side of the one or more recesses, and an analysis area. The reservoirs, fluid channels, and analysis area are arranged such that a test fluid is moved through reservoirs, fluid channels, and analysis area in a prescribed order by progressive application of a movable compression device to the flexible layer. At least one reservoir may be pre-loaded with a fluid. In some embodiments, the substantially rigid layer defines at least one fluid flow channel. In some embodiments, the fluid flow channel defined in the substantially rigid layer permits flow of fluid counter to the direction of progression of the movable compression device.

According to another aspect, a method comprises providing a composite wafer having a flexible layer and a substantially rigid layer adhered to the flexible layer. The flexible layer defines one or more recesses that are covered by the substantially rigid layer to form one or more reservoirs and one or more fluid channels among the one or more reservoirs. The method further includes contacting a movable compression device with the flexible layer, and progressively compressing the flexible layer such that when the movable compression device traverses the flexible layer, fluid is forced through the one or more fluid channels and the one or more reservoirs in a sequence determined by the layout of the one or more fluid channels and the one or more reservoirs. In some embodiments, the method further comprises stopping and restarting the progressive compression. In some embodiments, the progressive compression proceeds in a primary direction, and the method further comprises disengaging the movable compression device from the flexible layer; moving the movable compression device or the composite wafer or both to reposition the movable compression device with respect to the composite wafer; re-engaging the movable compression device with the flexible layer; and causing relative motion between the movable compression device and the composite wafer in a direction opposite the primary direction.

DETAILED DESCRIPTION OF THE INVENTION

Figure 1:
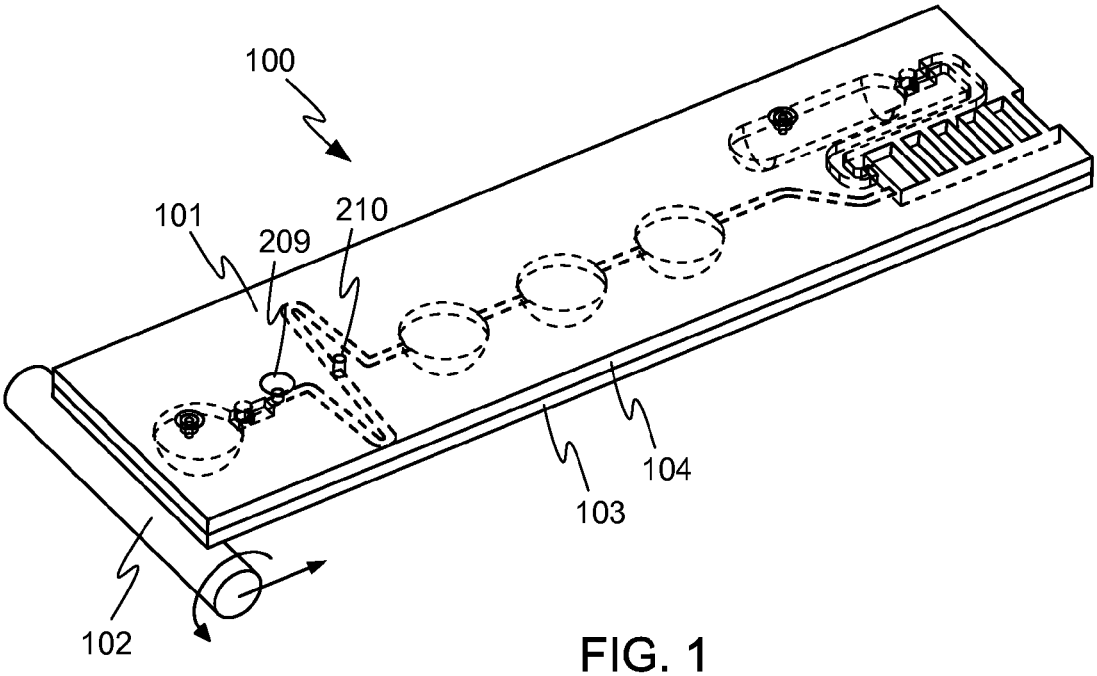
FIG. 1 illustrates a fluid manipulation device in accordance with embodiments of the invention, including a composite wafer and a movable compression device.

FIG. 1 illustrates a fluid manipulation device 100 in accordance with embodiments of the invention. Fluid manipulation device 100 includes a composite wafer 101 and a roller 102. As will be explained in more detail below, roller 102 is an example of a movable compression device.

Composite wafer 101 further comprises a flexible layer 103 and a substantially rigid layer 104. Flexible layer 103 may be made of a soft, readily-compressible polymer such as molded silicone rubber, polyester, or another suitable material or blend of materials. Substantially rigid layer 104 may be made of a substantially rigid plastic material such as polyester, polycarbonate, acrylonitrile butadiene styrene (ABS), acrylic, or another suitable material or a blend of materials.

Composite wafer 101 may be of any suitable size, but in some embodiments may be between about 10 and 50 mm wide and about 25-300 mm long. In one example embodiment, composite wafer 101 is 25.4×95.25 mm (1.0×3.75 inches). The flexible and substantially rigid layers may be any workable thickness, but in some embodiments may be between about 1 and 10 millimeters thick. In one example embodiment, flexible layer 103 is about 1.524 mm (0.06 inches) thick, and substantially rigid layer 104 is about 1.778 mm (0.07 inches) thick. It will be recognized that the size of the composite wafer may be selected in accordance with its intended use and the number of internal features required.

Figure 2:
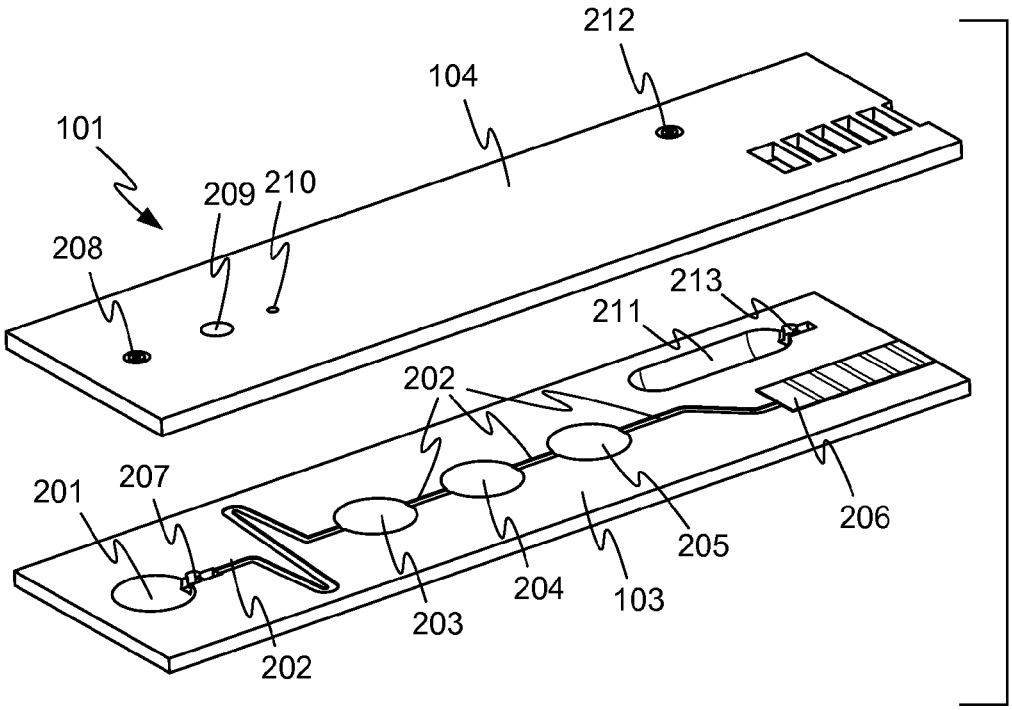
FIGS. 2 and 3 illustrate upper and lower exploded views of the composite wafer of FIG. 1.
Figure 3:
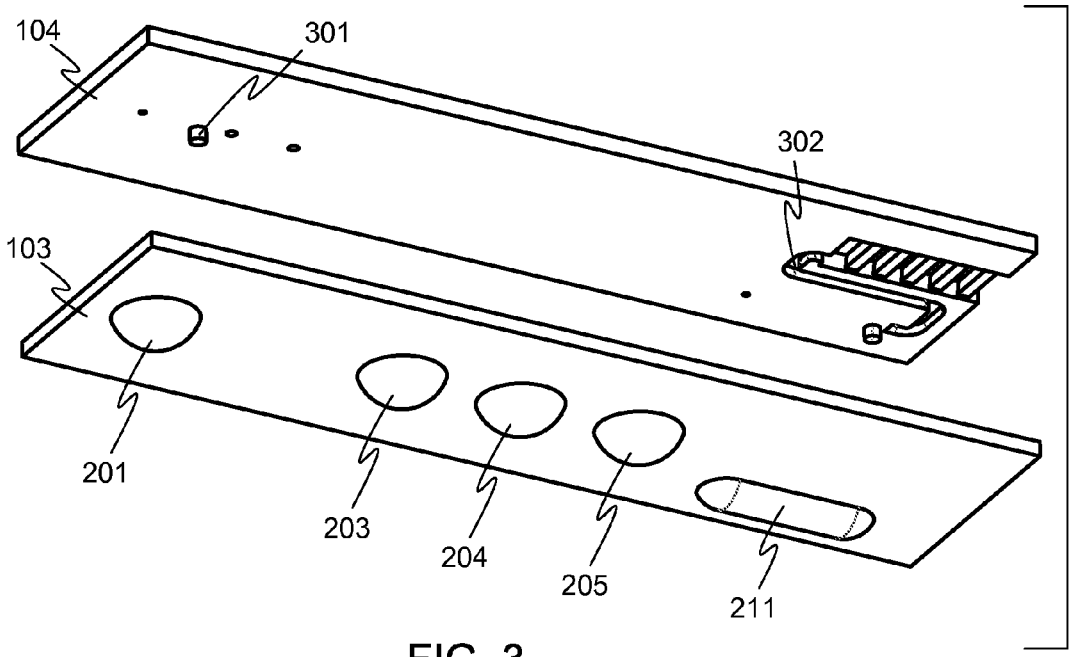

FIGS. 2 and 3 illustrate upper and lower exploded views of composite wafer 101, in accordance with embodiments of the invention. In example composite wafer 101, a reservoir 201 is molded into flexible layer 103. That is, a concave recess is molded into flexible layer 103. Reservoir 201 may be thin-walled, such that a convex back surface of reservoir 201 protrudes from the back side of flexible layer 103, as is shown in FIG. 3. In this case, reservoir 201 may resemble a blister.

Referring again to FIG. 2, also included in example composite wafer 101 are a series of fluid flow channels 202 connecting to additional reservoirs 203-205 and an analysis area 206. Example composite wafer 101 may be especially suited to the performance of an immunoassay to detect the concentration of HbA1c in blood, but it will be recognized that many other composite wafer configurations are possible for different applications.

Once substantially rigid layer 104 is adhered to flexible layer 103, substantially rigid layer forms a side of reservoirs 203-205 and fluid flow channels 202, so that the reservoirs and fluid flow channels are closed, other than their inlets and outlets within composite wafer 101.

During operation of composite wafer 101, roller 102 is advanced in the direction shown in FIG. 1, and "squeezes" flexible layer 103, including reservoirs 201 and 203-205 and fluid flow channels 202, to force fluids through the stages of a test, as is explained in more detail below. (The structure for holding roller 102 in contact with composite wafer 101 and for driving roller 102 is omitted from FIG. 1 for simplicity of illustration.)

In an example embodiment, reservoir 201 may be pre-loaded with a diluent to be used in testing blood for the level of HbA1c. A valve 207 prevents leakage of the diluent from reservoir 201 during shipping and storage, but permits the diluent to flow into fluid flow channel 202 under the impetus of roller 102.

Figure 4:
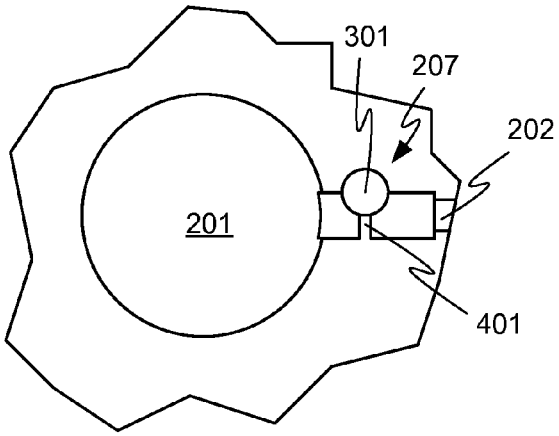
FIG. 4 illustrates an enlarged top view of a valve, in accordance with embodiments of the invention.

FIG. 4 illustrates an enlarged top view of valve 207, in accordance with embodiments of the invention. In example valve 207, a small flap 401 is formed of the material of flexible layer 103. Flap 401 extends partially across fluid flow channel 202, and contacts pin 301, which protrudes from substantially rigid layer 104, as is visible in FIG. 3. Pin 301 may be, for example, a molded feature of substantially rigid layer 104, or an additional part such as a metal pin pressed into substantially rigid layer 104. Flap 401 is shown in a light interference fit with pin 301, so that it will resist flow of fluid from reservoir 201 during normal shipping, handling, and storage of composite wafer 101. However, because flap 401 is made of the soft material of flexible layer 103, flap 401 can deflect under presser induced by roller 102, allowing fluid to flow from reservoir 201 past valve 207 and into fluid flow channel 202.

Referring again to FIG. 2, reservoir 201 may be pre-loaded with diluent through a filling port 208, which can be sealed off, for example by heat sealing or another suitable method, once reservoir 201 is pre-loaded.

Also provided in substantially rigid layer 104 is an analyte loading port 209. Analyte loading port 209 may be, for example a funnel-shaped opening through substantially rigid layer 104 and aligned with fluid flow channel 202. In the HbA1c testing example, a sample of a patient's blood may be supplied through analyte loading port 209, and may partially fill fluid flow channel 202 by capillary action. In some embodiments, a vent 210 may be provided through substantially rigid layer 104, aligned with a location on fluid flow channel 202 downstream from analyte loading port 209. The relationship of analyte loading port 209 and vent 210 to fluid flow channel 202 is also visible in FIG. 1. The purpose of vent 210 is to stop the capillary flow of analyte along fluid flow channel 202, so that a fixed quantity of the analyte is loaded into fluid flow channel 202 between analyte loading port 209 and vent 210.

In some embodiments, any analyte loading port such as analyte loading port 209 may be covered after the sample is loaded, for example with an adhesive sticker or other cover, to prevent the sample from being forced back out of composite wafer 101 during travel of roller 102. Similarly, any vents such as vent 210 may be covered.

Once the analyte, for example blood, is loaded through analyte loading port 209, roller 102 may be advanced to force the diluent into fluid flow channel 202, carrying the blood sample with it to reservoir 203. Reservoirs 203-205 may be used in other steps of the test being performed. For example, the sample may be kept in reservoir 203 for a period of time for a digestion step. The digestion may be facilitated by a reagent pre-loaded in reservoir 203 or present in the diluent that was pre-loaded in reservoir 201. The progress of roller 102 may be stopped once the sample is transferred into reservoir 203 in order to allow time for the digestion step to occur.

Roller 102 may then be advanced again, to force the sample into reservoirs 204 and 205 in turn. For example, reservoir 204 may contain a buffer that stops the digestion reaction, and reservoir 205 may be pre-loaded with antibodies selected to bind with glucose that may have attached to the hemoglobin in red blood cells in the blood sample being tested. For example, the antibodies may have been pre-loaded in reservoir 205 in a lyophilized form, or may be suspended in a fluid pre-loaded in reservoir 205. Multiple kinds of antibodies may be provided. The antibodies may be tagged with one or more fluorophores, to facilitate their detection later in the test as is explained below. Different antibodies may be tagged with different fluorophores. Additional reservoirs could be included, and could hold additional antibodies. If desired, additional loading ports similar to loading port 208 may be provided for reservoirs other than reservoir 201, and additional valves similar to valve 207 may be provided at other places in the fluid path in composite wafer 101, for example to isolate and contain fluids in other pre-loaded reservoirs for shipping and storage.

As with the digestion step, the advancement of roller 102 may be stopped and re-started as needed to allow time for reactions to occur at the various stages in the test being conducted.

In some embodiments, roller 102 may be utilized for enhancing mixing of components of the sample under test. For example, in the embodiment of FIGS. 1-3, once roller 102 has advanced so that the test fluid is contained in reservoir 205, roller 102 may be retracted out of contact with flexible layer 103 and advanced beyond reservoir 105. Roller 102 may then be re-engaged with flexible layer 103 and rolled in the reverse direction to force fluids rom reservoir 205 back into reservoir 204, through the portion of fluid channel 202 between reservoirs 204 and 205. Then, roller 102 may be retracted out of contact with flexible layer 103 and moved to a location upstream of reservoir 204, re-engaged with flexible layer 103, and again rolled toward reservoir 205 to force the fluids into reservoir 205. This process may be repeated as many times as desired. The fluid shear occurring on entry to and exit from fluid flow channel 202 may promote mixing and reaction of the fluid components.

Roller 102 may be further actuated to force the fluid under test to analysis area 206. Analysis area 206 may include, for example, an absorbent medium impregnated with proteins to which the antibodies from reservoirs 204 and 205 may attach. The absorbent medium may comprise nitrocellulose or another kind of absorbent medium. The test fluid may transport across the absorbent medium by capillary wicking action. Different areas of the absorbent medium may be impregnated with different proteins to which different antibodies may attach.

Composite wafer 101 may also include a washing fluid reservoir 211, also formed in flexible layer 103 and covered by substantially rigid layer 104. Washing fluid reservoir 211 may be pre-loaded with a washing fluid via loading port 212, similar to port 208, and a valve 213 similar to valve 207 may be provided to retain the washing fluid in washing fluid reservoir 211 during shipping and storage of composite wafer 101.

Washing fluid reservoir 211 may be connected with analysis area 206 by a flow channel 302 formed in substantially rigid layer 104 and visible in FIG. 3. For example, flow channel 302 may be molded or machined into substantially rigid layer 104, or formed by another suitable means.

The positioning of washing fluid reservoir 211 and the volume of flow channel 302 are such that the washing fluid forced from washing fluid reservoir 211 by the advancement or roller 102 arrives at analysis area 206 after all or substantially all of the test fluid has already contacted analysis area 206. The washing fluid may serve to carry away antibodies not bound to any of the proteins present in analysis area 206, removing stray antibodies that could otherwise interfere with interpretation of the test result. The washing fluid and other fluid components it carries may be exhausted into a collection area within a testing machine (not shown) performing the test, or into an additional collection reservoir (not shown) within composite wafer 101.

The example flow channel 302 in substantially rigid layer 104 permits flow of the washing fluid in the reverse direction to the motion of roller 102. It will be appreciated that reversals of direction of the flow within flexible layer 103 (flow counter to the direction of the travel of roller 102) may be difficult or impossible to achieve.

To read the result of the test, analysis area 206 may be illuminated in order to stimulate fluorescence of the fluorophores tagged to the antibodies adhering to the various areas of analysis area 206. The wavelengths and intensity of light emanating from analysis area 206 may be measured and interpreted to provide a test result.

It will be recognized that many, many variations from this example are possible within the scope of the appended claims. The number, size, and arrangement of reservoirs present in a particular composite wafer may be varied according to the intended use of the composite wafer. Valves, loading ports, analyte loading ports, and other features may be provided as needed, in any workable arrangement. Flow channels may split into parallel pathways, may rejoin, or may form any workable network of channels. Different kinds of analysis areas may be provided.

A composite wafer and actuator according to embodiments may be used for performing any workable medical test, for example DNA identification, or for other purposes. For example, reservoirs may be separately loaded with two parts of a two-part adhesive, and the two parts may be mixed and dispensed from the composite wafer by actions of the roller or other movable compression device.

Figure 5:
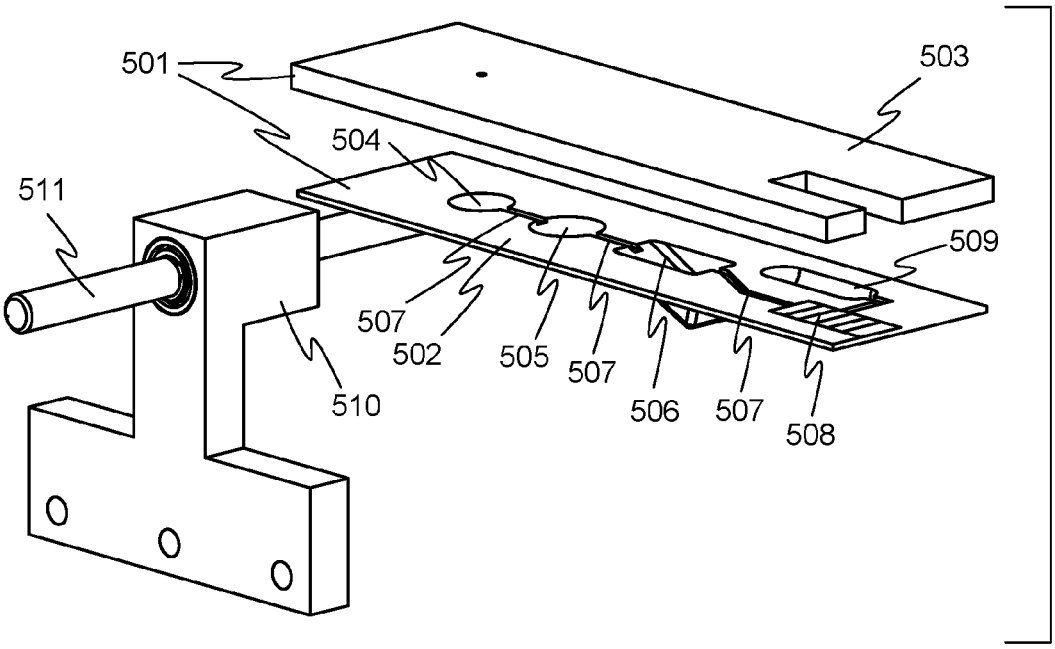
FIG. 5 illustrates an exploded view of another example composite wafer having a flexible layer and a substantially rigid layer, in accordance with embodiments of the invention.

FIG. 5 illustrates an exploded view of another example composite wafer 501 having a flexible layer 502 and a substantially rigid layer 503. Composite wafer 501 includes some basic features similar to features of composite wafer 101 discussed above, for example reservoirs 504, 505, and 506, and fluid flow channels 507 connecting reservoirs 504, 505, and 506. An analysis area 508 is present, as is a washing fluid reservoir 509. Composite wafer 501 may be designed for performing a specific medical test, or for another purpose, and illustrates some variations possible in embodiments of the invention. For example, reservoir 506 is of a different shape than the other reservoirs. Also, washing fluid reservoir is positioned sufficiently far "downstream" that no reverse flow is necessary for the washing fluid in washing fluid reservoir to reach analysis area 508. Thus, the fluid flow channel connecting washing fluid reservoir 509 and analysis area 508 can be formed in flexible layer 502 rather than in substantially rigid layer 503.

Also shown in FIG. 5 is a bearing block 510, which is an example of a machine component for holding roller 511. Other machine parts may be present, but are omitted from the figures for clarity. It will be recognized that in embodiments using a roller such as roller 102 or roller 511, the compressing action may be accomplished by moving the composite wafer with respect to the roller, moving the roller with respect to the composite wafer, or moving both the composite wafer and roller such that relative motion between the two is achieved.

Figure 6:
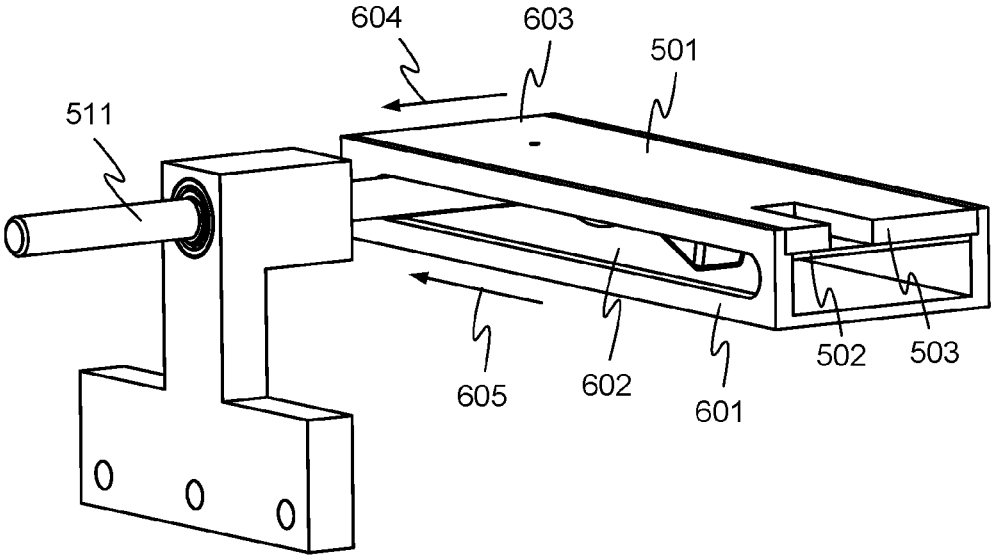
FIG. 6 illustrates the composite wafer of FIG. 5 in a holder, in accordance with embodiments of the invention.

FIG. 6 illustrates composite wafer 501 in a holder 601, in accordance with embodiments. Because flexible layer 502 forms one side of composite wafer 501, it may be desirable to protect flexible layer 502 from damage or inadvertent compression during shipping and handling. In the example of FIG. 6, composite wafer 501 is placed in a protective rigid holder 601. Holder 601 may define a slot 602 to accommodate roller 511. For example, roller 511 and holder 601 may be positioned such that roller 511 is at starting end 603 of composite wafer 501, and holder 601 and roller 511 moved together (as symbolized by arrow 604) to engage roller 511 and composite wafer 501. Then, roller 511 and composite wafer 501 can undergo relative motion (as symbolized by arrow 605) to progressively compress flexible layer 502. While the relative motion between roller 511 and composite wafer 501 is linear in the example of FIG. 5, other arrangements may be used, as is explained in more detail below.

In other embodiments, other kinds of movable compression devices may be used. For example, a set of solenoid-driven plungers may be aligned with the reservoirs in the flexible layer, and may compress the reservoirs in turn under the control of a controller. In another example, actuators made of a memory metal such as nitinol may be placed under the reservoirs, and may be caused to compress individual reservoirs by selective heating of the nitinol actuators. Many other kinds of movable compression devices may be envisioned.

Figure 7:
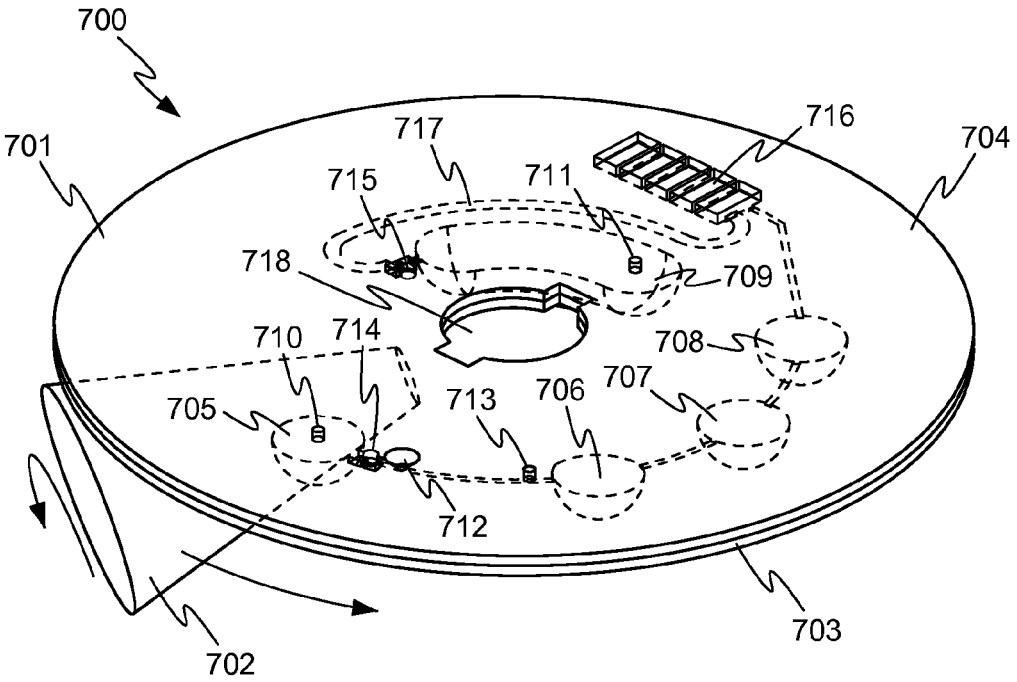
FIG. 7 illustrates a fluid manipulation device in accordance with a rotary embodiment.

In some embodiments, a rotary system may be utilized in place of the linear motion of a roller such as roller 511. FIG. 7 illustrates a fluid manipulation device 700 in accordance with a rotary embodiment. Fluid manipulation device 700 includes a circular composite wafer 701 and a roller 702. Roller 702 is an example of a movable compression device.

Fluid manipulation device 700 is a rotary analogue of example fluid manipulation device 100, and includes components similar to the components of fluid manipulation device 100, but in a rotary arrangement. For example, composite wafer 701 includes a flexible layer 703 and a substantially rigid layer 704. Reservoirs 705-709 may hold diluents, reagents, washing fluid, or other materials, depending on the intended use of fluid manipulation device 700. Loading ports such as ports 710 and 711 may be provided for pre-loading reservoirs as needed. An analyte loading port 712 and vent 713 may be provided for loading a predetermined quantity of an analyte into the system. Valves such as valves 714 and 715 may be provided to retain fluids preloaded into composite wafer 701 during shipping, handling, and storage. An analysis area 716 may include, for example, a nitrocellulose strip as discussed above, and may receive washing fluid from washing fluid reservoir 709 after the test fluid, by virtue of reverse channel 717 formed in substantially rigid layer 704. Opening 718 may accommodate a keyed shaft (not shown) for rotating composite wafer 701, or for preventing its rotation. Other mechanisms for creating relative motion between composite wafer 701 and roller 702 may be envisioned.

Figure 8:
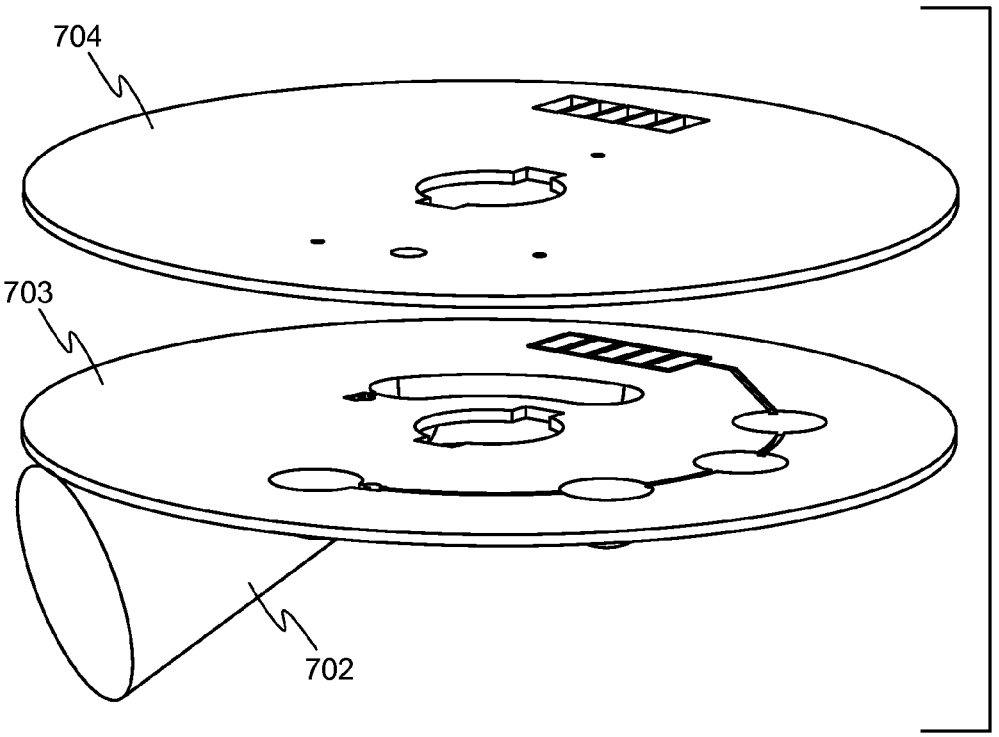
FIG. 8 illustrates an exploded upper view of the system of FIG. 7.
Figure 9:
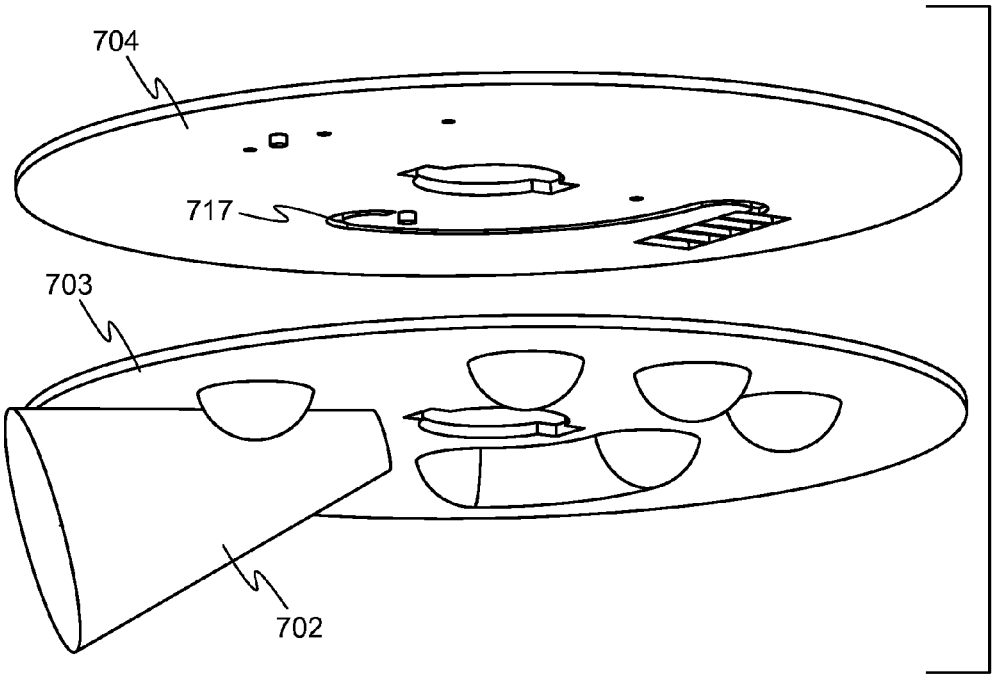
FIG. 9 illustrates an exploded lower view of the system of FIG. 7.

FIG. 8 shows an exploded upper view of the system of FIG. 7, and FIG. 9 shows an exploded lower view of the system of FIG. 7. Particularly visible in FIG. 9 is reverse flow channel 717, formed in substantially rigid layer 704.

Figure 10:
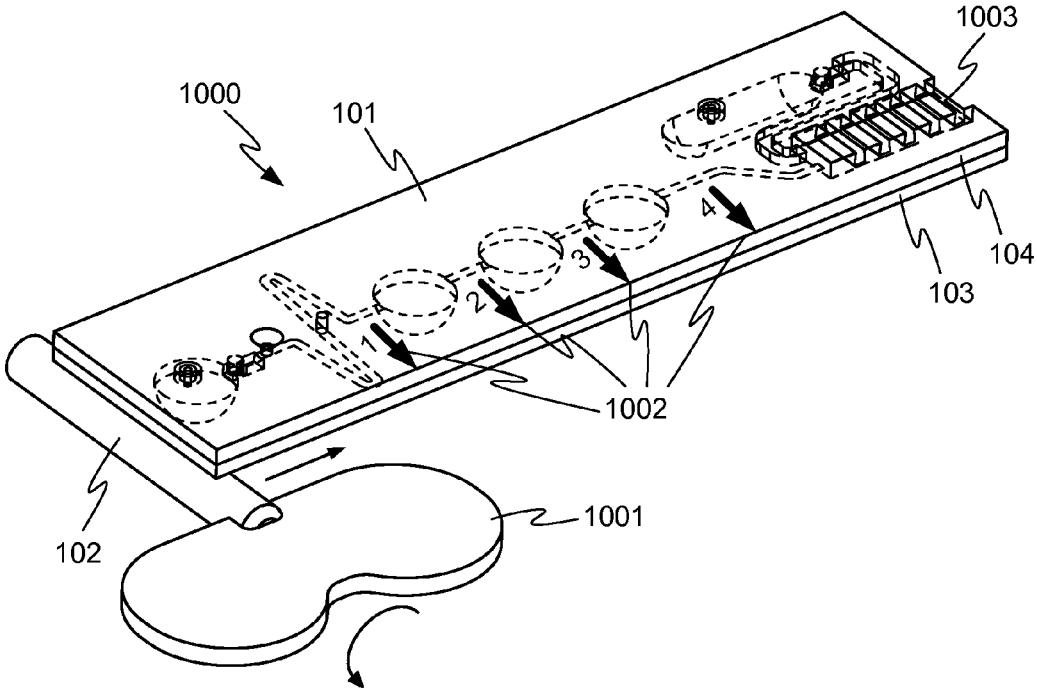
FIG. 10 illustrates a hand-powered embodiment.

Because a composite wafer according to embodiments of the invention does not require any external pressure source, embodiments of the invention may be especially amenable to use in remote locations where electric power or other utilities may be limited, unavailable, or unreliable. FIG. 10 illustrates a hand-powered embodiment of a system using a composite wafer 1000. Roller 102 may be driven by turning wing lever 1001 by hand. (In FIG. 10, it is assumed that composite wafer 1000 and roller 102 are supported by an appropriate mechanical holder, which may include, for example, a gear rack or other mechanism for causing roller 102 to translate when it is rotated using wing lever 1001.) Composite wafer 1000 may include visible checkpoints 1002. Instructions provided with composite wafer 1000 may direct the user to, after loading an analyte, to turn wing lever 1001 to drive roller 102, stopping for prescribed periods of time when roller 102 reaches certain checkpoints. Thus, sophisticated medical tests may be performed without the need for a complex controller. Other kinds of manual actuators may be used in place of wing lever 1001, for example a crank, knob, or other kind of manual actuator.

Preferably for field use, analysis area 1003 is constructed to present the test results using visible light. Alternatively, upon completion of the movement of roller 102, analysis area 1003 may be illuminated using a battery-powered portable light source, and then photographed (possibly through an appropriate filter) to make a record of the test. The photograph may be transmitted, for example by cellular telephone, to a remote location for interpretation of the test results.

In the claims appended hereto, the term "a" or "an" is intended to mean "one or more." The term "comprise" and variations thereof such as "comprises" and "comprising," when preceding the recitation of a step or an element, are intended to mean that the addition of further steps or elements is optional and not excluded.

It is to be understood that any workable combination of the elements and features disclosed herein is also considered to be disclosed.

The invention has now been described in detail for the purposes of clarity and understanding. However, those skilled in the art will appreciate that certain changes and modifications may be practiced within the scope of the appended claims.

What is claimed is:

1. A system for fluid manipulation, the system comprising:

a composite wafer having a flexible layer and a substantially rigid layer adhered to the flexible layer, the flexible layer defining one or more recesses that are covered by the substantially rigid layer to form one or more reservoirs and one or more fluid channels among the one or more reservoirs, wherein the substantially rigid layer also defines at least one fluid flow channel within the substantially rigid layer; and a movable compression device in contact with the flexible layer and configured to progressively compress the flexible layer such that when the movable compression device traverses the flexible layer, fluid is forced through the one or more fluid channels and the one or more reservoirs in a sequence determined by the layout of the one or more fluid channels and the one or more reservoirs;

wherein the movable compression device is a roller, and wherein the fluid flow channel defined within the substantially rigid layer is positioned such that the roller forces fluid through the fluid flow channel within the substantially rigid layer past the roller in a direction counter to the direction of motion of the roller.

2. The system of claim 1, wherein the movable compression device is a cylindrical roller.

3. The system of claim 1, wherein the movable compression device is a conical roller.

4. The system of claim 1, wherein at least one of the one or more reservoirs is pre-loaded with a fluid.

5. The system of claim 4, further comprising at least one valve formed in the flexible layer, each valve preventing flow of fluid from a pre-loaded reservoir until the fluid is forced from the reservoir by action of the movable compression device.

6. The system of claim 4, wherein at least one of the one or more reservoirs is pre-loaded with a diluent.

7. The system of claim 4, wherein at least one of the one or more reservoirs is pre-loaded with a reagent.

8. The system of claim 4, wherein at least one of the one or more reservoirs is pre-loaded with an antibody.

9. The system of claim 1, wherein the substantially rigid layer defines a sample loading port for loading a sample of an analyte into the composite wafer.

10. The system of claim 1, wherein the composite wafer further comprises a sampling medium to which fluid is delivered from one of the fluid flow channels.

11. The system of claim 1, wherein:

a first one of the reservoirs is pre-loaded with a diluent;

the substantially rigid layer defines a sample loading port connected by one of the fluid flow channels downstream of the first reservoir for loading a sample of an analyte into the composite wafer; and a second one of the reservoirs is connected by one of the fluid flow channels downstream of the sample loading port, such that upon actuation of the movable compression device, diluent is forced from the first reservoir, and carries the analyte to the second reservoir in a test fluid.

12. The system of claim 11, further comprising a sampling medium, wherein the test fluid is delivered from the second reservoir to the sampling medium via one of the fluid flow channels.

13. The system of claim 12, wherein one or two additional reservoirs are disposed between the second reservoir and the sampling medium.

14. The system of claim 12, wherein:

a third reservoir is pre-loaded with a washing fluid; and the substantially rigid layer defines a fluid flow layer that delivers the washing fluid to the sampling medium.

15. The system of claim 14, wherein the third reservoir is positioned such that the advancement of the movable compression device forces the washing fluid from the third reservoir after the test fluid has reached the sampling medium.

16. The system of claim 12, wherein the analyte is blood, and the system is configured to perform process steps in the measurement of HbA1c in the blood.

17. The system of claim 1, wherein the movable compression device is configured to be manually actuated.

18. The system of claim 1, wherein the movable compression device and the composite wafer undergo rotary relative motion.

19. The system of claim 1, wherein the movable compression device and the composite wafer undergo linear relative motion.

20. The system of claim 1, further comprising a protective holder that substantially encloses the flexible layer, the protective holder defining an opening providing access to the flexible layer by the movable compression device.

21. A fluid manipulation device, comprising:

a flexible layer having one or more recesses in one face, the one or more recesses defining one or more reservoirs and one or more fluid channels among the one or more reservoirs;

a substantially rigid layer adhered to a face of the flexible layer such that the substantially rigid layer forms a closing side of the one or more recesses; and an analysis area;

wherein the reservoirs, fluid channels, and analysis area are arranged such that a test fluid is moved through reservoirs, fluid channels, and analysis area in a prescribed order by progressive application of a movable compression device to the flexible layer;

and wherein the substantially rigid layer also defines at least one fluid flow channel within the substantially rigid layer;

and wherein the fluid flow channel defined within the substantially rigid layer is positioned such that the movable compression device forces fluid through the fluid flow channel within the substantially rigid layer past the movable compression device in a direction counter to the direction of motion of the movable compression device with respect to the fluid manipulation device.

22. The fluid manipulation device of claim 21, wherein at least one reservoir is pre-loaded with a fluid.

23. The fluid manipulation device of claim 21, wherein the substantially rigid layer defines at least one fluid flow channel.

24. The fluid manipulation device of claim 23, wherein the fluid flow channel defined in the substantially rigid layer permits flow of fluid counter to the direction of progression of the movable compression device.

25. A method, comprising:

providing a composite wafer having a flexible layer and a substantially rigid layer adhered to the flexible layer, the flexible layer defining one or more recesses that are covered by the substantially rigid layer to form one or more reservoirs and one or more fluid channels among the one or more reservoirs, wherein the substantially rigid layer also defines at least one fluid flow channel within the substantially rigid layer; and contacting a movable compression device with the flexible layer; and progressively compressing the flexible layer such that when the movable compression device traverses the flexible layer, fluid is forced through the one or more fluid channels and the one or more reservoirs in a sequence determined by the layout of the one or more fluid channels and the one or more reservoirs;

wherein the movable compression device is a roller, and wherein the fluid flow channel defined within the substantially rigid layer is positioned such that the roller forces fluid through the fluid flow channel within the substantially rigid layer past the roller in a direction counter to the direction of motion of the roller.

26. The method of claim 25, further comprising stopping and restarting the progressive compression.

27. The method of claim 25, wherein the progressive compression proceeds in a primary direction, the method further comprising:

disengaging the movable compression device from the flexible layer;

moving the movable compression device or the composite wafer or both to reposition the movable compression device with respect to the composite wafer;

re-engaging the movable compression device with the flexible layer; and causing relative motion between the movable compression device and the composite wafer in a direction opposite the primary direction.

* * * * *